US011852135B2

(12) United States Patent
Barnhouse, Jr.

(10) Patent No.: US 11,852,135 B2
(45) Date of Patent: Dec. 26, 2023

(54) RETAINER NUT ASSEMBLY FOR PUMP AND METHODS

(71) Applicant: SPM Oil & Gas Inc., Fort Worth, TX (US)

(72) Inventor: James A. Barnhouse, Jr., Spring, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 14 days.

(21) Appl. No.: 17/554,793

(22) Filed: Dec. 17, 2021

(65) Prior Publication Data

US 2023/0193896 A1 Jun. 22, 2023

(51) Int. Cl.
*F04B 53/00* (2006.01)
*F04B 19/22* (2006.01)

(52) U.S. Cl.
CPC ..... *F04B 53/00* (2013.01); *F04B 19/22* (2013.01)

(58) Field of Classification Search
CPC ..... F04B 19/22; F04B 53/00
See application file for complete search history.

(56) References Cited

U.S. PATENT DOCUMENTS

| | | | | |
|---|---|---|---|---|
| 2,867,350 | A * | 1/1959 | Fleckenstein | B65D 39/088 220/301 |
| 3,259,075 | A | 7/1966 | Roth | |
| 3,327,643 | A * | 6/1967 | Pangburn | F04B 53/168 92/171.1 |
| 3,430,575 | A | 3/1969 | Roth | |
| 8,402,880 | B2 | 3/2013 | Patel et al. | |
| 8,529,230 | B1 | 9/2013 | Colley, III et al. | |
| 10,962,001 | B2 | 3/2021 | Nowell et al. | |
| 2008/0093361 | A1* | 4/2008 | Kennedy | F04B 53/16 220/233 |
| 2013/0034757 | A1* | 2/2013 | Doyle | H01M 50/35 429/89 |
| 2019/0011051 | A1* | 1/2019 | Yeung | F04B 1/0538 |
| 2020/0370548 | A1* | 11/2020 | Chady | F04B 53/22 |
| 2021/0088167 | A1 | 3/2021 | Chunn | |
| 2021/0131479 | A1 | 5/2021 | Freed et al. | |

* cited by examiner

*Primary Examiner* — Connor J Tremarche

(57) ABSTRACT

A retainer nut assembly for a fluid end of a pump system includes a plug with two blades separated by edge cuts, a plug exterior face and a threaded rod extending from the plug exterior face. Each of the blades includes an arcuate face. A mid-cap includes a hole for receiving the threaded rod therethrough with the mid-cap positioned adjacent the plug. The mid-cap further includes flange segments. A cover cap includes a hole for receiving the threaded rod therethrough with the cover cap positioned adjacent the mid-cap. The cover cap has extensions separated by cut outs. Each of the extensions are configured to extend axially between respective flange segments of the mid-cap when the cover cap is assembled to the mid-cap. A fastener engages the threaded rod and secures the retainer nut assembly together.

20 Claims, 11 Drawing Sheets

RETAINER NUT ASSEMBLY FOR PUMP AND METHODS

TECHNICAL FIELD

The present disclosure relates to pump assemblies and retainer nut assemblies for such pump assemblies and methods of assembly.

BACKGROUND

In hydraulic fracturing, and other similar applications, the pumping equipment used to pump fluid media into a well is an important part of the fracturing system and process. Reciprocating pump systems have been used for decades to propel a fluid media, typically a mixture of water, sand, and chemicals, for example, into a well at high pressures and flow rates. Increasing demands of pressure pumping has required such pumps to evolve by increases in size, horsepower rating, and pressure capabilities. As a result, designing pump assemblies to be reliable and easily maintained has become an increasingly important consideration.

Reciprocating pump systems typically include fluid end blocks with fluid inlet and outlet passages for the fluid media. Each of the fluid inlets and fluid outlets include a check valve to control the flow of fluid through the fluid end block. Such pump systems have a plunger that generates the substantial pumping pressures required to pump the fluid media through the pump. Pump systems typically have both a cover assembly and a retainer nut for access to the inner workings of the fluid end of the pump for initial assembly and maintenance.

Current hydraulic fracturing fluid ends typically use a threaded retainer nut to retain a suction cap in position in the fluid end block. To tighten the retainer nut, the use of a hammer wrench and a sledgehammer are typically required to generate a preload in the threads. The use of the hammer can give an imprecise result and is a swinging mass that exposes the user to harm. Due the nature of the pumping process and high forces generated in the fluid end block; the retainer nut can work loose. The threaded connection of the retainer nut to the fluid end block concentrates the stresses on the threads. This creates the potential of the retainer nut being forcefully ejected from the fluid end block if the threads fail and/or may cause damage to the block itself.

U.S. Pat. No. 8,402,880 discloses a pump system with a fluid block. A retaining system secures a closure at an installed position within a bore of the fluid block. The bore has screw threads along at least a portion thereof. The closure has an internally threaded hold extending therein. The closure in the installed position closes the bore. The retaining system includes a retaining cover or nut for holding the closure in the bore. The retaining nut has external threads that are engageable with the screw threads of the bore such that the cover is rotatable relative to the housing in a tightening direction for movement of the cover into the bore toward the closure and rotatable in an opposite, loosening direction for movement of the cover out from the bore away from the closure.

There is a need for an easily assembled and reliable retainer nut for a fluid end of a pump system. Devices and methods according to the disclosure satisfy the need.

The foregoing background discussion is intended solely to aid the reader. It is not intended to limit the innovations described herein, nor to limit or expand the prior art discussed. Thus, the foregoing discussion should not be taken to indicate that any element of a prior system is unsuitable for use with the innovations described herein, nor is it intended to indicate that any element is essential in implementing the innovations described herein. The implementations and application of the innovations described herein are defined by the appended claims.

SUMMARY

In one aspect, the disclosure includes a retainer nut assembly for a fluid end of a pump system that includes a plug with two blades separated by edge cuts. The plug may include a plug exterior face and a threaded rod extending from the plug exterior face. Each of the blades includes an arcuate face. A mid-cap may include a hole configured to receive the threaded rod therethrough with the mid-cap positioned adjacent the plug. The mid-cap further includes flange segments. A cover cap may include a hole configured to receive the threaded rod therethrough with the cover cap positioned adjacent the mid-cap. The cover cap has extensions separated by cut outs. Each of the extensions are configured to extend axially between respective flange segments of the mid-cap when the cover cap is assembled to the mid-cap. A fastener secures the retainer nut assembly together.

In another aspect, the disclosure includes a fluid end for a reciprocating pump system including a fluid end block defining a fluid chamber. The fluid end includes a plunger reciprocally disposed in the fluid chamber to generate fluid pressure therewithin. An outlet fluid passage is formed in the fluid end block in fluid communication with the fluid chamber, the outlet fluid passage including an outlet valve. An inlet fluid passage is formed in the fluid end block in fluid communication with the fluid chamber and includes an inlet valve. A cavity is formed through the fluid end block in communication with the fluid chamber, the cavity including a first locking groove and a second locking groove, the second locking groove parallel to the first locking groove and disposed closer to the fluid chamber, the first locking groove and the second locking groove having an annular shape. Locking tabs are separated by gaps formed in the cavity and separate the first locking groove from the second locking groove. A retainer nut assembly is configured to be sealingly secured in position within the cavity.

In yet another aspect, the disclosure includes a method of installing a retainer nut assembly into a fluid end block for a reciprocating pump system, the method including positioning a plug of a retainer nut assembly in a second locking groove of a cavity formed in the fluid end block. A mid-cap is positioned adjacent the plug in the cavity. A cover cap is positioned adjacent the mid-cap in the cavity in a first locking groove. The cover cap, the mid-cap, and the plug are fastened together and thereby the mid-cap and the plug are secured to locking tabs located between the first locking groove and the second locking groove which closes the cavity.

DETAILED DESCRIPTION

Figure 1:
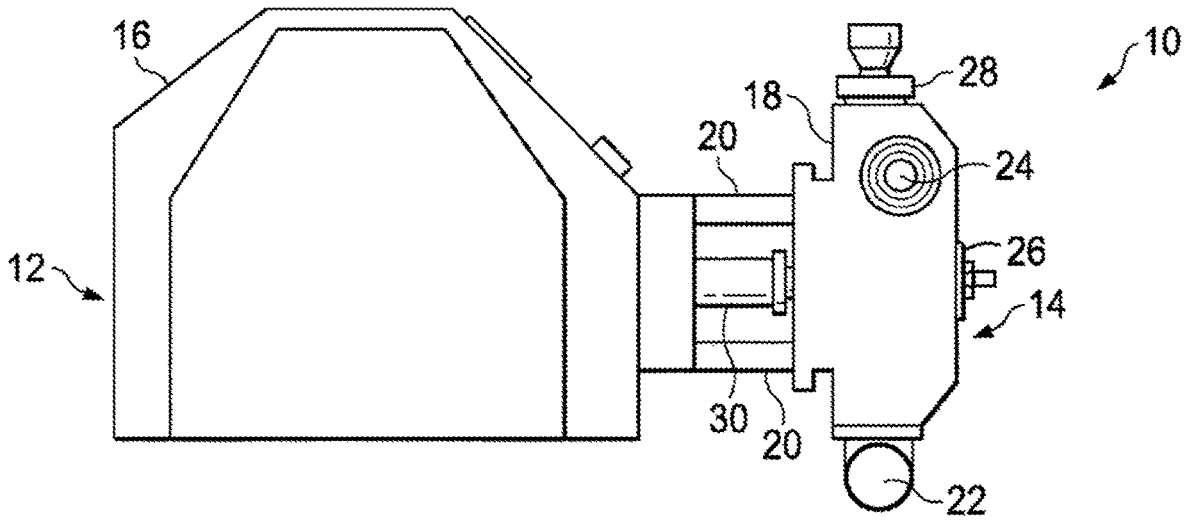
FIG. 1 is an elevation view of a reciprocating pump system according to the disclosure, the reciprocating pump system including a fluid end.

Now referring to the drawings, wherein like elements refer to like reference numbers, there is illustrated in FIG. 1 an exemplary embodiment of a reciprocating pump system (generally referred to by the reference numeral 10) including a power end portion 12 and a fluid end portion 14 operably coupled thereto. The power end portion 12 includes a housing 16 in which a crankshaft (not shown) is disposed, as is known, the crankshaft being operably coupled to an engine or motor (not shown), as is known, which is configured to drive the crankshaft. The fluid end portion 14 includes a fluid end block 18, which is connected to the housing 16 via a plurality of stay rods 20. The fluid end block 18 includes a fluid inlet passage 22 and a fluid outlet passage 24, which are spaced in a parallel relation. A plurality of fluid end retainer nut assemblies 26, one of which is shown in FIG. 1, is connected to the fluid end block 18 opposite the stay rods 20. A plurality of cover assemblies 28, one of which is shown in FIG. 1, is connected to the fluid end block 18 opposite the fluid inlet passage 22. A plunger rod assembly 30 extends out of the housing 16 and into the fluid end block 18. Other configurations of a reciprocating pump system 10 are contemplated.

Figure 2:
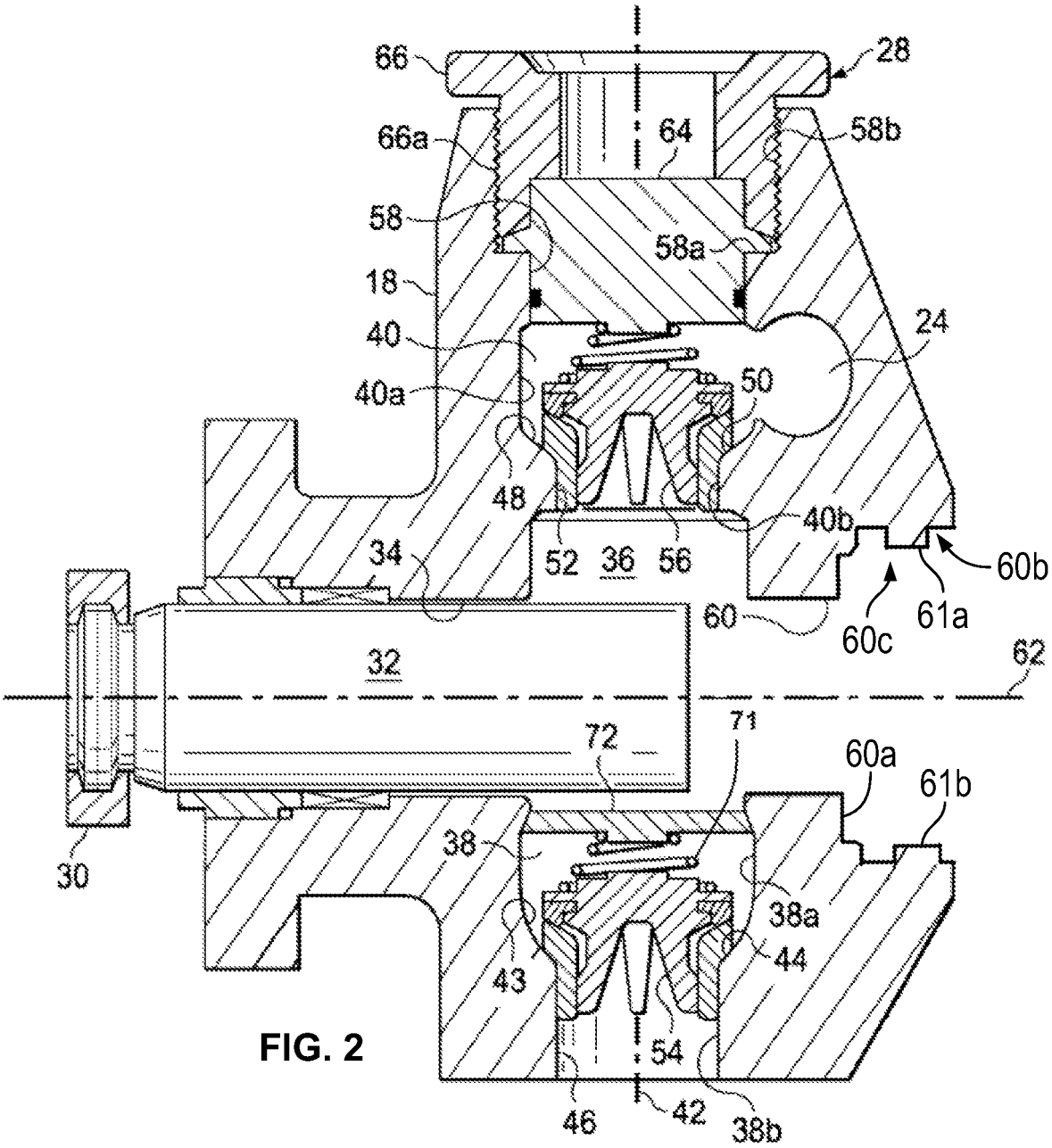
FIG. 2 is a section view of the fluid end of FIG. 1, the fluid end including a fluid end block and inlet and outlet valves.
Figure 3:
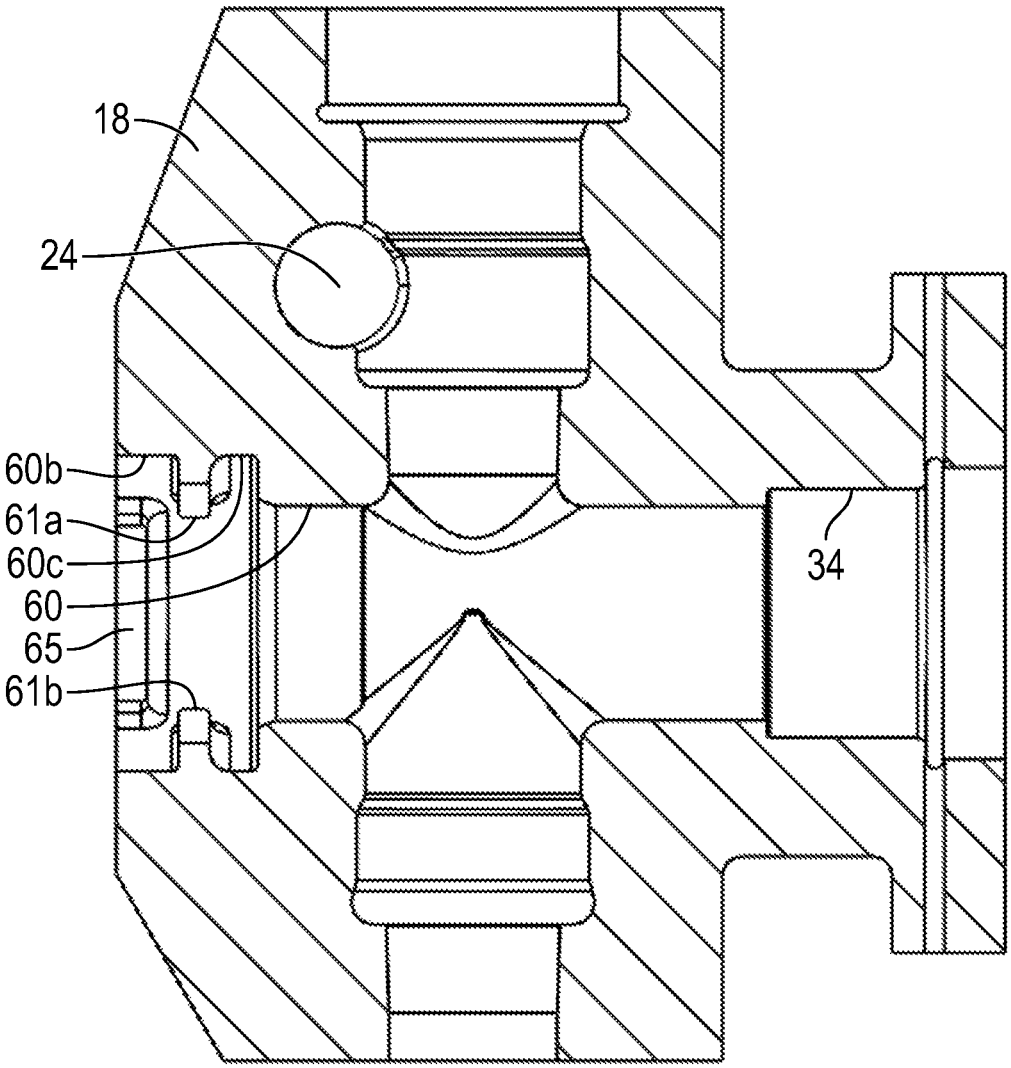
FIG. 3 is a section view of the fluid end of FIG. 1 with components removed to show the retainer nut cavity.

In embodiments, as illustrated in FIG. 2 with continuing reference to FIG. 1, the plunger rod assembly 30 includes a plunger 32, which extends through a bore 34 formed in the fluid end block 18, and into a fluid chamber 36 formed in the fluid end block 18. The plunger 32 is reciprocally disposed in the fluid chamber 36 to generate fluid pressure therewithin. In embodiments, a plurality of parallel-spaced bores may be formed in the fluid end block 18, with one of the bores being the bore 34, a plurality of fluid chambers may be formed in the fluid end block 18, with one of the fluid chambers being the fluid chamber 36, and a plurality of parallel-spaced plungers may extend through respective ones of the bores and into respective ones of the fluid chambers, with one of the plungers being the plunger 32.

The fluid end block 18 includes inlet and outlet fluid passages 38 and 40 formed therein, which may be generally coaxial along a fluid passage axis 42. Under conditions to be described below, fluid flows from the inlet fluid passage 38 toward the outlet fluid passage 40 along the fluid passage axis 42. The fluid inlet passage 22 is in fluid communication with the fluid chamber 36 via the inlet fluid passage 38. The fluid chamber 36 is in fluid communication with the fluid outlet passage 24 via the outlet fluid passage 40.

The inlet fluid passage 38 may include an enlarged-diameter portion 38*a* and a reduced-diameter portion 38*b* extending downward therefrom (as in the figure), which direction may also be considered the upstream direction. Downstream from the enlarged-diameter portion 38*a* is an inlet fluid passage neck 38*c*, which is reduced in diameter relative to the enlarged-diameter portion.

The enlarged diameter portion 38*a* defines a tapered internal shoulder 43 and thus a frusto-conical surface 44 of the fluid end block 18. The reduced-diameter portion 38*b* defines an inside surface 46 of the fluid end block 18. Similarly, the outlet fluid passage 40 includes an enlarged-diameter portion 40*a* and a reduced-diameter portion 40*b* extending downward therefrom. The enlarged-diameter portion 40*a* defines a tapered internal shoulder 48 and thus a frusto-conical surface 50 of the fluid end block 18. The reduced-diameter portion 40*b* defines an inside surface 52 of the fluid end block 18. The frusto-conical surfaces 44, 50 form valve seats for respective inlet and outlet valves 54, 56.

An inlet valve 54 is disposed in the inlet fluid passage 38 and engages at least the frusto-conical surface 44 and the inside surface 46. Similarly, an outlet valve 56 is disposed in the outlet fluid passage 40 and engages at least the frusto-conical surface 50 and the inside surface 52. In an exemplary embodiment, each of valves 54 and 56 is a spring-loaded valve that is actuated by a predetermined differential pressure thereacross.

A counterbore 58 is formed in the fluid end block 18 and is generally coaxial with the outlet fluid passage 40 along the fluid passage axis 42. In embodiments, the fluid end block 18 may include a plurality of parallel-spaced counterbores, one of which may be the counterbore 58, with the quantity of counterbores equaling the quantity of plunger throws included in the pump system 10. The cover assembly 28 shown in FIGS. 1 and 2 includes at least a plug 64 and a fastener 66. In embodiments, the cover assembly 28 may be disconnected from the fluid end block 18 to provide access to, for example, one or more of the counterbore 58, the fluid chamber 36, the plunger 32, the outlet fluid passage 40 or the outlet valve 56. In embodiments, the pump system 10 may include a plurality of plugs, one of which is the plug 64, and a plurality of fasteners, one of which is the fastener 66, with the respective quantities of plugs and fasteners equaling the quantity of plunger throws included in the pump system 10.

A cavity 60 sized and shaped to receive the retainer nut 26 is formed in the fluid end block 18, which may be generally coaxial with the bore 34 along an axis 62. The cavity 60 is a passageway or irregular hole formed through the fluid end block 18 in communication with the fluid chamber 36. The cavity 60 is formed free of threads. The cavity 60 includes an internal shoulder 60*a* and includes a first locking groove 60*b* and a second locking groove 60*c*. The second locking groove 60*c* is located inboard of the first locking groove 60*b*, i.e., positioned relatively closer to the fluid chamber 36. It will be understood that the cavity 60 is shaped and sized to house a conventional plug (not shown for clarity but similar to plug 64 shown in FIG. 2) for sealing the fluid chamber 36 as is known, and which is held in position by the retainer nut 26.

The first locking groove 60*b* and the second locking groove 60*c* are both annular, radially formed grooves, relative to the axis 62, formed into the fluid end block 18 outboard relative to the internal shoulder 60*a*. The first locking groove 60*b* is separated from the second locking groove 60*c* and is partially defined by a pair of spaced apart inboard locking tabs 61*a*, 61*b*. Each of the inboard locking tabs 61*a*, 61*b* extends in a 90-degree arc (π/2 radians), approximately, about the inside of the retainer nut cavity 60 and extends radially inwardly toward axis 62. The inboard locking tabs 61*a*, 61*b* are located opposite each other, and are separated and defined by spaces or gaps 63, one of which is shown in FIG. 4, defined between the inboard locking tabs, which also extend a 90-degree arc, approximately, or about one quarter of the circumferential distance about the cavity 60 (π/2 radians).

Figure 4:
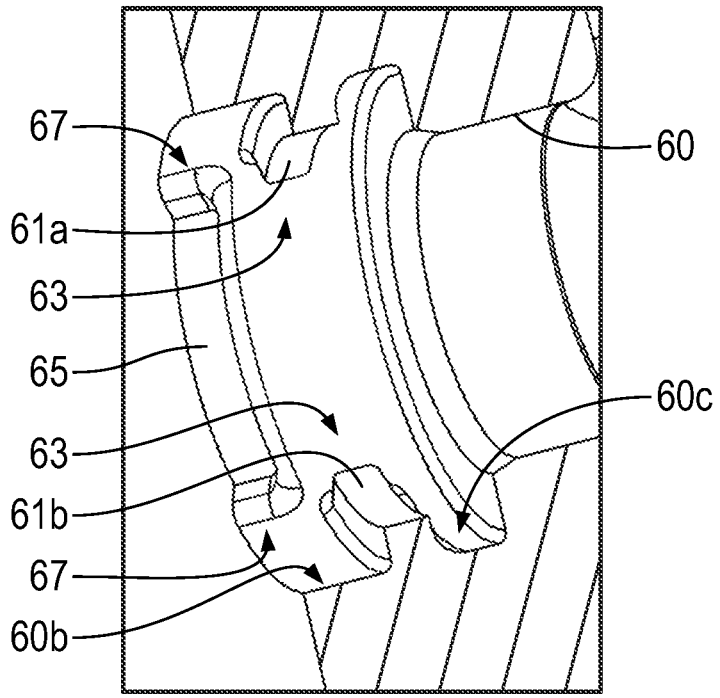
FIG. 4 is a close-up perspective view of the cavity of FIG. 3.

The block 18 includes a pair of spaced apart outboard locking tabs 65, one of which is shown in FIG. 4. Each of the outboard locking tabs 65 extends in a 90-degree arc (π/2 radians), approximately, about the inside of the retainer nut bore 60 and extends radially inwardly toward axis 62. The outboard locking tabs 65 are located opposite each other and define spaces or gaps 67, shown in FIG. 4, defined between outboard locking tabs 65, and extend a 90-degree arc (π/2 radians), approximately, or about one quarter of the circumferential distance about the cavity 60. The inboard locking tabs 61*a*, 61*b* and outboard locking tabs 65 are displaced or positioned 90-degrees circumferentially with respect to each other. Accordingly, the gaps 63, 67 defined between the inboard and outboard tabs 61*a*, 61*b*, and 65 are also displaced 90-degrees circumferentially with respect to each other. In other words, assuming that the inboard locking tabs 61*a*, 61*b* are positioned at 12 o'clock and 6 o'clock when viewing into the cavity 60 along axis 62 into the fluid chamber 36, the outboard tabs 65 are positioned at 3 o'clock and 9 o'clock.

In embodiments, the fluid end block 18 includes a plurality of parallel-spaced cavities, one of which may be the cavity 60, with the quantity of cavities equaling the quantity of plunger throws included in the pump system 10. The cavity 60 is sized and shaped to receive a retainer nut assembly 26 (see FIG. 6) according to embodiments disclosed herein. In embodiments, the retainer nut assembly 26 may be disconnected from the fluid end block 18 to provide access to, for example, the cavity 60, the fluid chamber 36, the plunger 32, the inlet fluid passage 38, and the inlet valve 54. The retainer nut assembly 26 may then be reconnected to the fluid end block to fluidly seal the cavity 60. In several exemplary embodiments, the pump system 10 may include a plurality of cavities, one of which is the cavity 60, and a plurality of retainer nut assemblies, one of which is the retainer nut assembly 26, with the respective quantities of cavities and retainer nut assemblies equaling the quantity of plunger throws included in the pump system 10.

Focusing now on the inlet fluid passage 38, a biasing member 71 is positioned within the inlet fluid passage 38. The biasing member 71 may be a coil spring. In one embodiment the biasing member 71 is a conical coil spring. The biasing member 71 may be retained in place by a spring stop 72 as is known. When installed as shown in FIG. 2, the biasing member 71 exerts a selected biasing force on the inlet valve 54 that holds the inlet valve against the frusto-conical surface 44 to create a closed or sealed condition. When a pressure differential on the inlet valve 54 exceeds the closing force generated by the biasing member 71, the inlet valve opens and permits fluid media to enter the fluid chamber 36.

Figure 5:
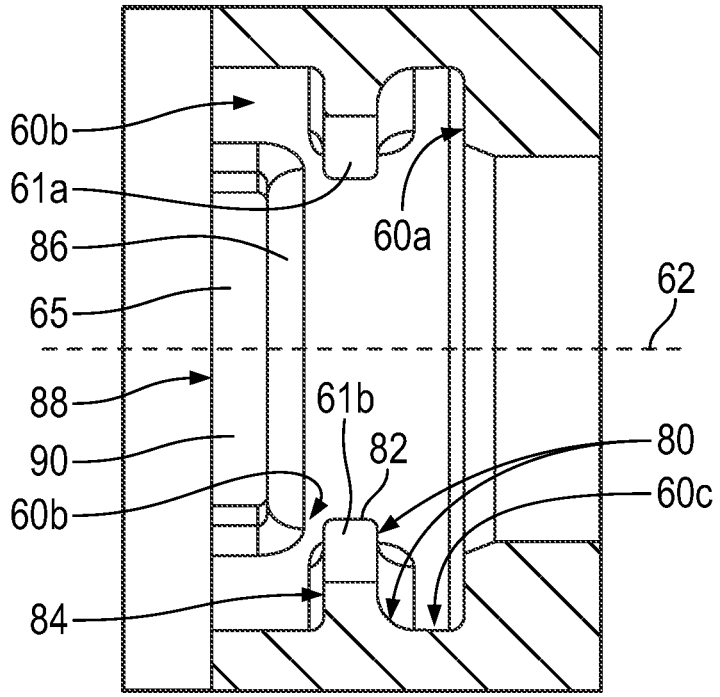
FIG. 5 is a close-up section view of the cavity of FIG. 3.

FIG. 5 shows the shape of the inboard locking tabs 61*a*, 61*b* and outboard tabs 65 (only one shown). Each of the inboard tabs 61*a*, 61*b* are arcuate ring-shaped segments or bodies extending about a 90-degree circumference about the cavity 60. The shoulder 60*a* lies in a plane that is normal to the axis 62. The inboard face 80 (closer to the fluid chamber 36) of each of the locking tabs 61*a*, 61*b* is arcuate, in that the face includes a fillet or curvature that extends a distance at least about half way from the cavity 60 to the radially inward most extent 82 of each locking tab. The radius of the inboard face 80 may be from about 0.25 inches to about 2 inches in curvature. The outboard face 84 each of the locking tabs 61*a*, 61*b* is substantially all in a plane normal to the axis 62. The outboard tabs 65 (one is shown) are constructed similarly to that of the locking tabs 61*a*, 61*b*. The inboard face 86 of each of the outboard tabs 65 may be arcuate, in that the face includes a fillet or curvature that extends a distance at least about half way from the cavity 60 to the radially inward most extent 90 of each tab. The radius of the curvature of the inboard face 86 may be from about 0.25 inches to about 2 inches. The outboard face 88 of each of the outboard tabs 65 may be planar. The extent and number of tabs 61*a*, 61*b*, and 65 may be varied from the above discussed example to cooperate with features of the retainer nut assembly 26 depending on embodiments thereof.

Figure 6:
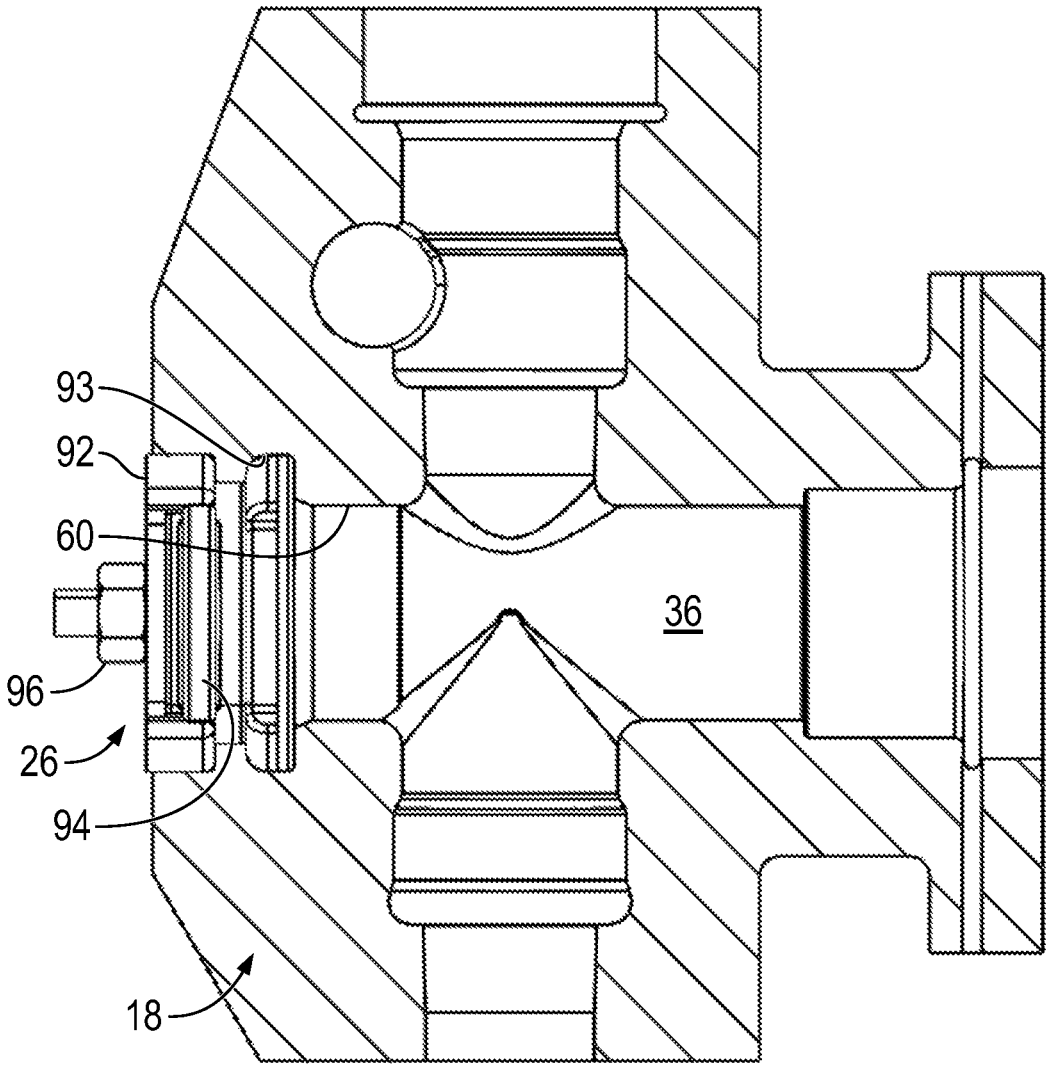
FIG. 6 is a section view of the fluid end as in FIG. 3, with the retainer nut positioned within the cavity.
Figure 7:
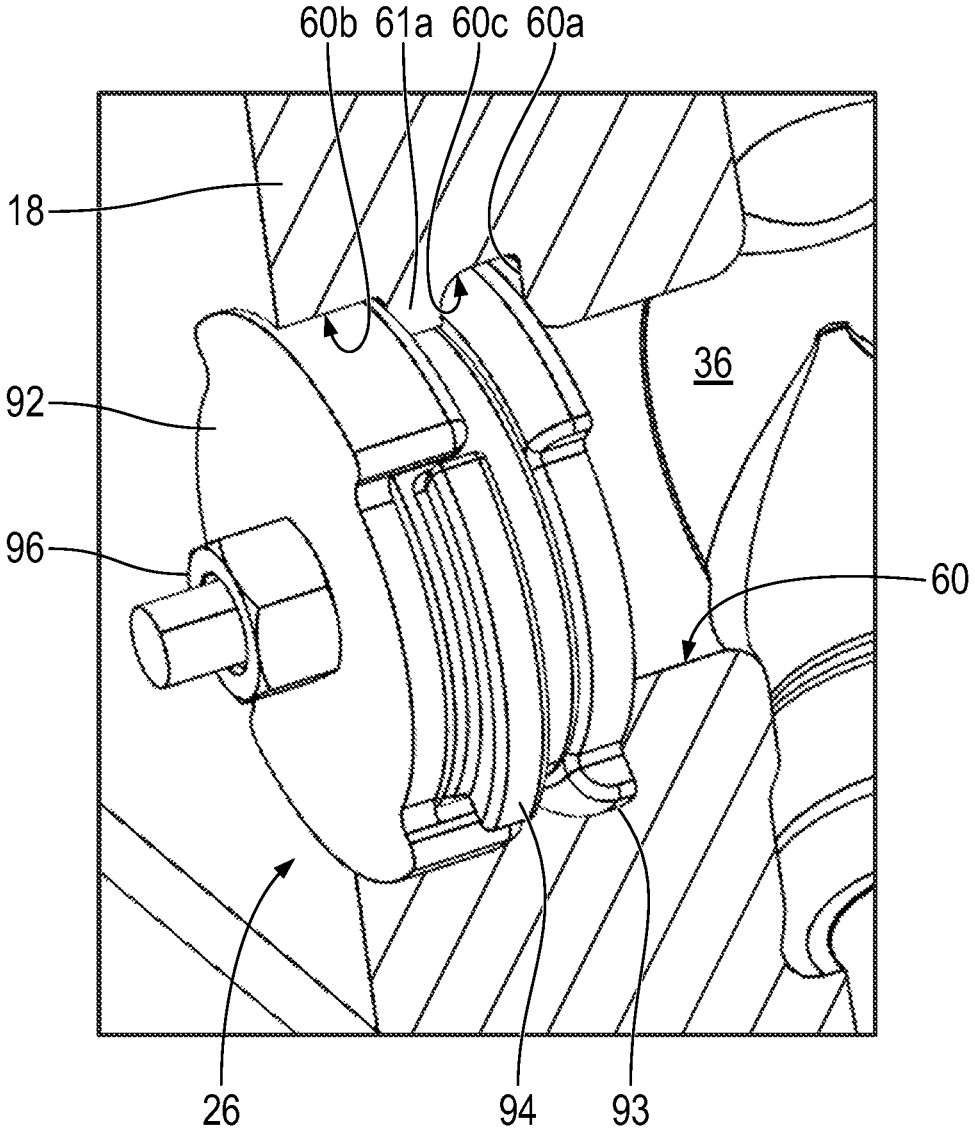
FIG. 7 is a perspective close-up view of FIG. 6.
Figure 8:
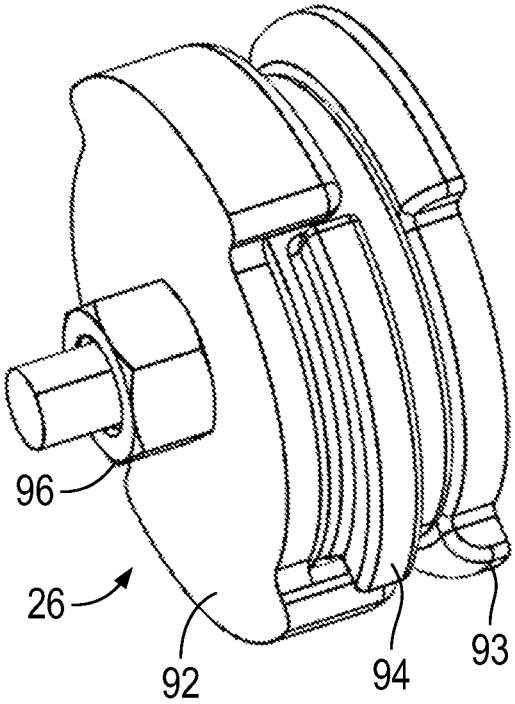
FIG. 8 is a perspective view of the retainer nut in an assembled state.

Turning to FIGS. 6-7, the retainer nut assembly 26, shown in an assembled state in the cavity 60, includes three main parts: a cover cap 92, located in an outermost position relative to the fluid chamber 36, a plug 93 opposite the cover cap and a mid-cap 94 located between the cover cap and the plug. A standard hex nut fastener 96 may be used to fasten the components together, when tightened, and causes the retainer nut assembly 26 to be secured to the inboard locking tabs 61*a*, 61*b* when the retainer nut assembly is located within the cavity 60 of the fluid end block 18. The nut 96 may be replaced by a bolt that threads into the plug 93 for example. It will be understood that the main parts may be coupled together by any suitable fastener arrangement, including nuts, bolts, cam closing arrangements, other clamping arrangements, and so on without limitation.

When installed, the plug 93 is located within the second locking groove 60*c* with the plug drawn against the inboard face 80 of each of the locking tabs 61*a*, 61*b* (see also FIG. 5). The cover cap 92 is located within the first locking groove 60*b*. The mid-cap 94 is located between the cover cap 92 and the plug 93. Tightening of fastener 96 secures the retainer nut assembly 26 in position in the cavity 60. A method of installing and securing the retainer nut assembly 26 is discussed in further detail below.

Figure 9:
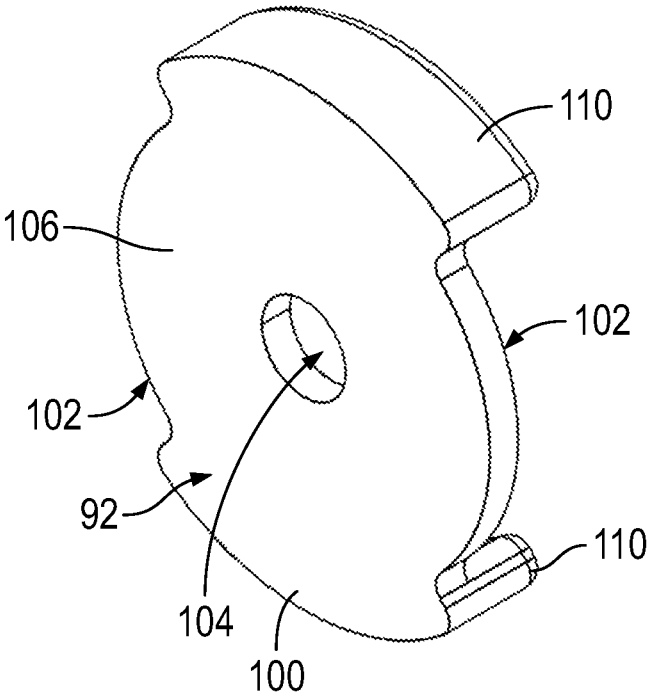
FIG. 9 is a perspective outer view of a cover cap portion of a retainer nut assembly.
Figure 10:
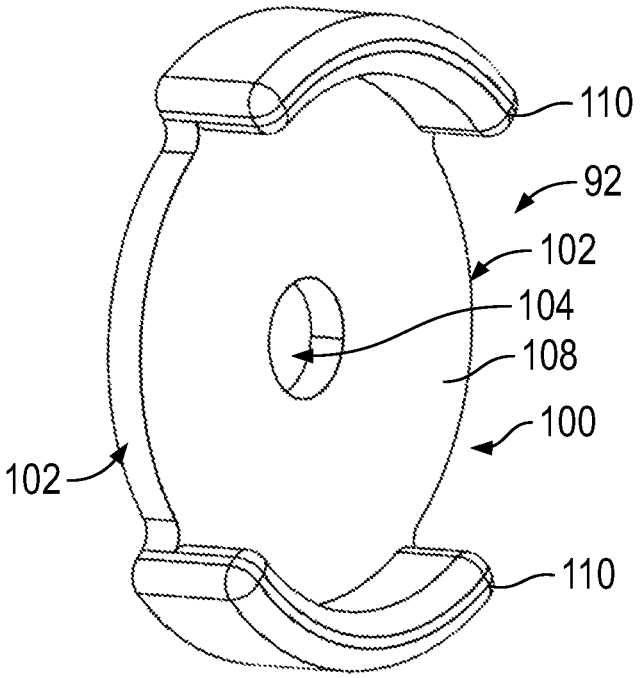
FIG. 10 is a perspective inner view of the cover cap portion of FIG. 9.
Figure 11:
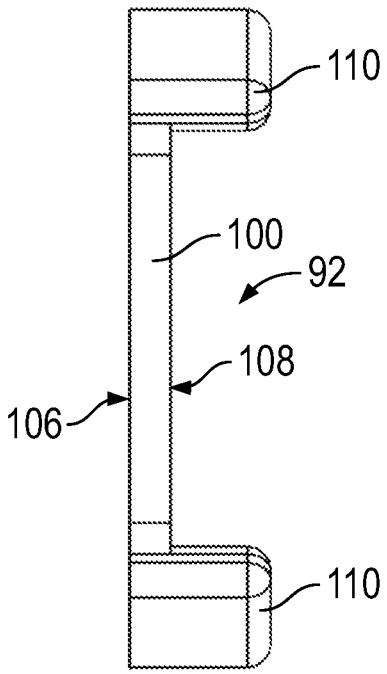
FIG. 11 is a side view of the cover cap portion of FIG. 9.

FIGS. 8-16 show in detail each of the three main parts of the retainer nut assembly 26 according to the disclosure. Specifically, FIGS. 9-11 show the cover cap 92. The cover cap 92 has a generally circular disc-shaped cover cap body 100 with two opposed cut outs 102 formed into the periphery or edge of the body. The term "opposed," for purposes of the present disclosure, means located opposite each other. The cut outs 102 are notches or curved relieved portions that are shaped and sized to receive the outboard tabs 65, one of the each of the outboard tabs 65 on each side of the cover cap body 100 when the cover cap 92 is inserted into the cavity 60. The fit of the cover cap 92 to the outboard tabs 65 prevents rotation of the cover cap when in position in the cavity 60. A hole 104 is formed axially centrally through the cover cap body 100. The hole 104 is smooth sided, i.e., not threaded.

The cover cap 92 may have a planar cover outer face 106 and a planar cover inner face 108 opposite the cover outer face. The cover cap 92 includes a pair of opposed cover extensions 110 which are formed at the peripheral edge of the cover cap body 100. The cover extensions 110 extend axially inwardly from the cover inner face, i.e., toward the fluid chamber 36 when installed. Each of the cut outs 102 and the cover extensions 110 extend about an arc length of about 90 degrees about the outer circumference of the cover cap body 100. The cover extensions 110 are sized and shaped to fit snugly within the gaps 67 between adjacent outboard locking tabs 65. The cover cap 92 fits substantially without significant spaces in the portion of the cavity 60 defined by outboard tabs 65 and gaps 67 and rotatably fixed with respect to the fluid end block 18 when inserted into the cavity. The cover cap 92 may have more than two cut outs, for example, three, four, or more in number with extensions formed therebetween.

Figure 12:
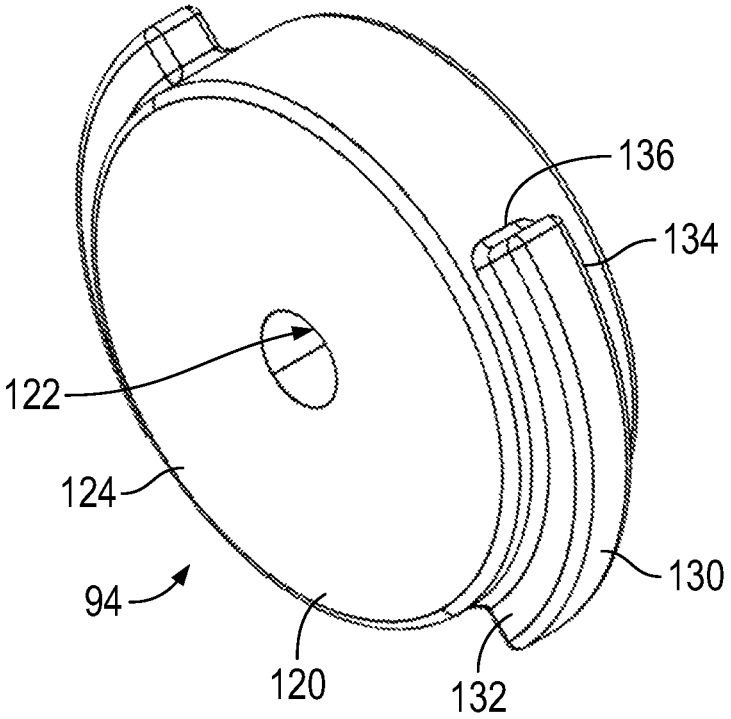
FIG. 12 is a perspective outer view of a mid-cap portion of a retainer nut assembly.
Figure 13:
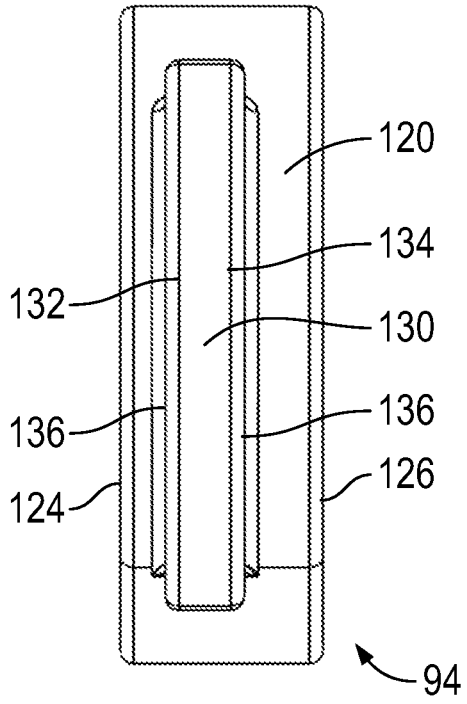
FIG. 13 is a side inner view of the mid-cap portion of FIG. 12.
Figure 14:
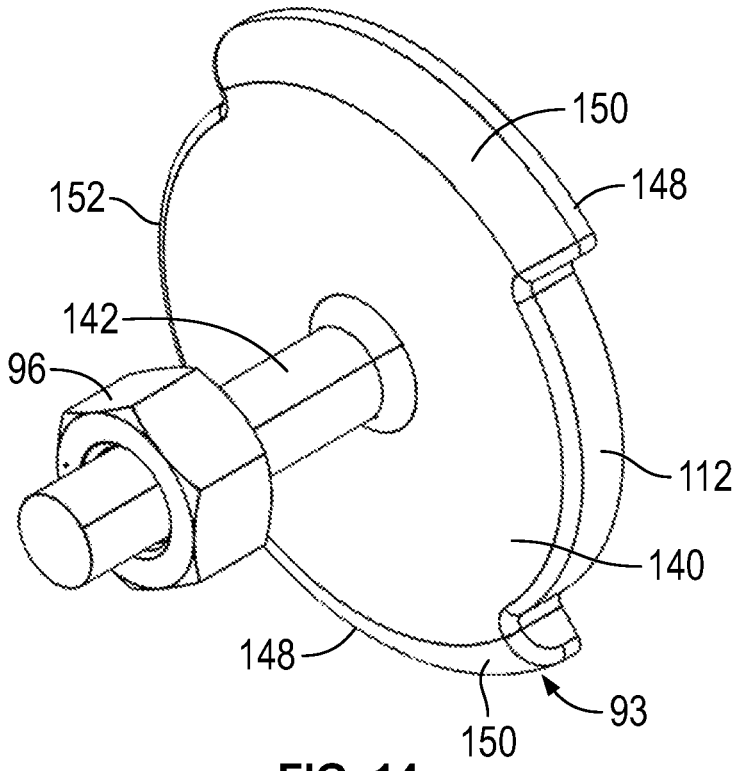
FIG. 14 is a perspective outer view of a plug of a retainer nut assembly with a fastener.

FIGS. 12-14 show the mid-cap 94. The mid-cap 94 includes a mid-cap body 120, which is generally cylindrical, through which a hole 122 is formed axially. The hole 122 is formed without threads and is positioned to align axially with the hole 104 of the cover cap 92 when the mid-cap body is positioned within the extensions 110 of the cover cap 92 against the inner face 108 of the cover cap (see also FIGS. 8-11). The mid-cap body 120 includes a mid-cap front face 124 and a mid-cap rear face 126 opposite the mid-cap front face. Both the mid-cap front face 124 and the mid-cap rear face 126 may be planar or at least a complementary, mating shape to that of respective cover cap 92 and plug 93.

The mid-cap 94 includes a pair of opposed flange segments 130. The flange segments 130 are radial tabs extending from the mid-cap body 120 and each extend about the circumference of the body an arc length of about 90-degrees about the circumference of the cylindrical body. Each of the flange segments 130 may be positioned axially closer to the mid-cap front face 124 than the mid-cap rear face 126.

Each of the flange segments 130 are shaped and sized to fit between adjacent extensions 110 of the cover cap 92 when assembled, i.e., within the angular positions of the cutouts 102. Each of the flange segments 130 have a flange front face 132 and a flange rear face 134 opposite the flange front face. The flange front face 132 and the flange rear face 134 are substantially planar with a fillet 136 at the base thereof where the flange front face 132 and the flange rear face 134 meet the cylindrical body 120.

The flange segments 130 fit to the outboard faces 84 of the locking tabs 61*a*, 61*b* and the inboard face 86 of the outboard locking tabs 65. Each flange rear face 134 is positioned against an outboard face 84 of a respective one of the locking tabs 61*a*, 61*b* and each flange front face 132 is positioned against an inboard face 86 of a respective one of the outboard locking tabs 65. The mid-cap 94 is prevented from rotating relative to the fluid end block 18 when assembled to the cover cap 92 and inserted into the cavity 60. The mid-cap 94 may have more than two segments, for example, three, four, or more in number.

Figure 15:
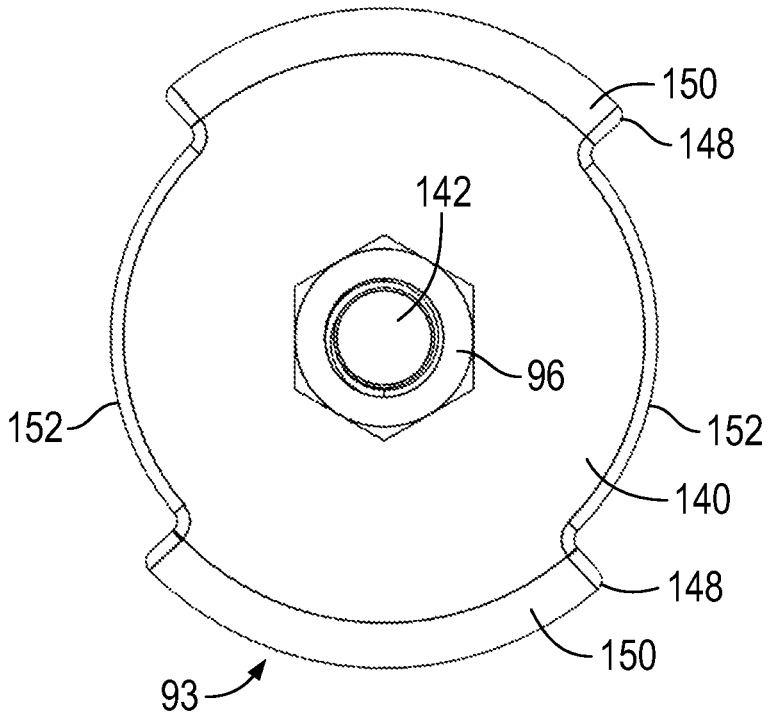
FIG. 15 is an outer view of the plug of FIG. 14.
Figure 16:
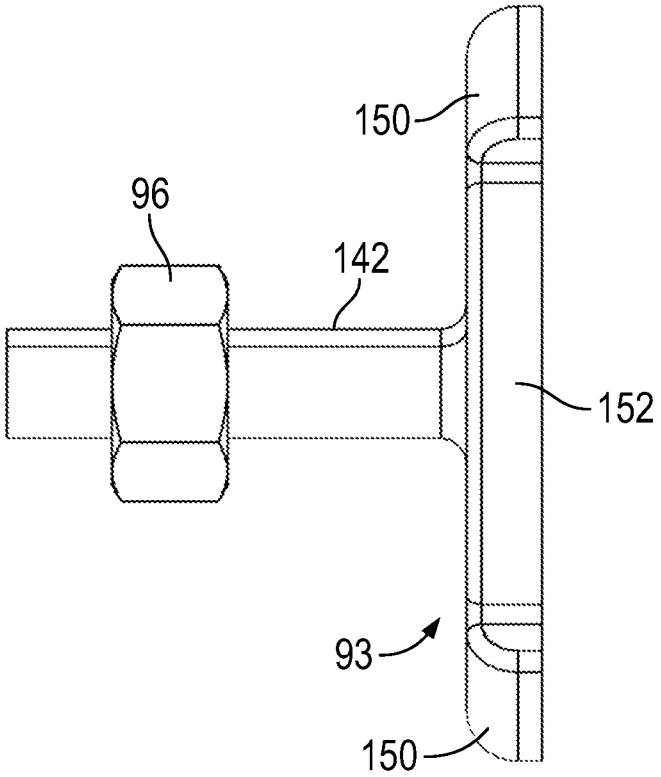
FIG. 16 is a side view of the plug of FIG. 14.

FIGS. 14-16 illustrate a plug 93 of the retainer nut assembly 26 and fastener 96. The fastener 96 may be a hex nut or any suitable fastener or arrangement that provides fastening. The plug 93 includes a plug body 140, which is generally cylindrical, and a threaded rod 142 extending to pass through the hole 122 of the mid-cap 94 and the hole 104 of the cover cap 92 when assembled. Further, the threaded rod 142 has a length suitable to receive the fastener 96 and for the fastener to be accessed by a worker to tighten or release the fastener when assembling and fastening the retainer nut assembly 26 in position in the cavity 60 and removing the retainer nut assembly.

The plug 93 has a plug exterior face 144 to which the threaded rod 142 is attached and from which the threaded rod extends. The plug body 140 includes a plug interior face 146 opposite the plug exterior face 144. The plug interior face 146 may be planar. The plug interior face 146 faces the fluid chamber 36 and when assembled into the cavity 60 and closes the fluid chamber 36 such that fluid is prevented from exiting the fluid end block 18 via the cavity.

In particular, the plug body 140 includes two spaced blades 148, defined by edge cuts 152, which extend radially outwardly from the plug body. The blades 148 are positioned to align with the extensions 110 of the cover cap 92 when the retainer nut assembly 26 is assembled together.

Each spaced blade 148 may have an arcuate face 150 that is arcuate shaped and sized to match the curvature shape of the inboard face 80 of the locking tabs 61*a*, 61*b*, i.e., a matching a radius from about 0.25 inches to about 2 inches. The faces 150 may be a continuation of the plug body exterior face 144. In other words, the faces 150 may be a continuous, uninterrupted surface with the exterior face 144. In one example, the locking tabs 61*a*, 61*b* both taper in the radially inward direction creating the curvature shape of the inboard face 80 and the face 150 has a complementary, matching curvature such that the seal face engages the inboard face along its entire surface. The arcuate surface or contact area of the faces 150 and the inboard face 80 provides a robust connection therebetween which provides a load capacity and fatigue strength greater than that which would be afforded by a threaded connection provided by a conventional retention nut. The plug 93 may have more than two blades, for example, three, four, or more in number.

INDUSTRIAL APPLICABILITY

The industrial applicability of the system described herein will be readily appreciated from the forgoing discussion. The foregoing discussion is applicable to fluid ends of reciprocating pump assemblies for pumping fluid media in fracturing operations and similar applications.

Figure 17:
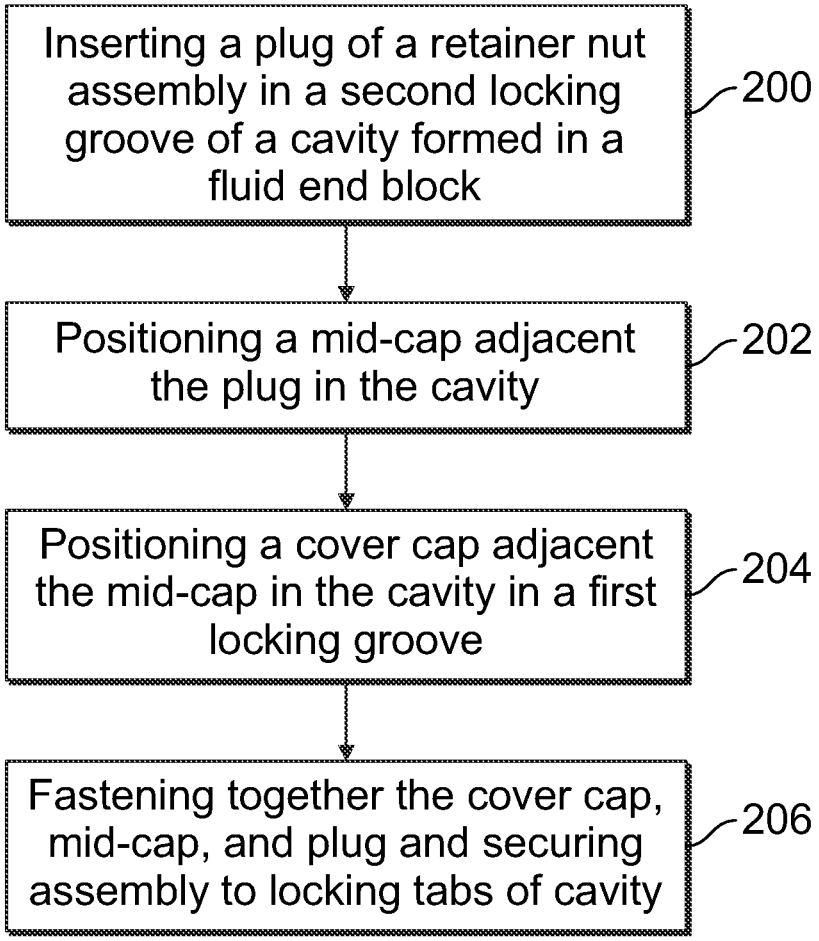
FIG. 17 is a method of assembling a fluid end retainer nut.

One example of the industrial application of the system according to embodiments of the disclosure, and referring also to the figures, a method of installing a retainer nut assembly 26 includes installing the retainer nut assembly into a fluid end block 18 of a fluid end 14 of a reciprocating pump system 10. In embodiments, and referring to FIG. 17, in step 200, the installation includes positioning a plug 93 of a retainer nut assembly 26 in a second locking groove 60*c* of a cavity 60 formed in a fluid end block 18. In step 202, a mid-cap 94 is positioned adjacent the plug 93 in the cavity 60. In step 204, a cover cap 92 is positioned adjacent the mid-cap 94 in the cavity 60 and in a first locking groove 60*b*. In step 206, the cover cap 92, mid-cap 94 and plug 93 are fastened together and secured to locking tabs 61*a*, 61*b*, wherein the locking tabs are located between the first locking groove 60*b* and the second locking groove 60*c*, and in so doing closing the cavity 60. The cover cap 92, mid-cap 94 and plug 93 may be positioned within the cavity 60 separately or as an assembly.

It will be understood that when installing the plug 93 the blades 148 will be aligned with the gaps 67 and then rotated (for example 90 degrees or a quarter turn) to align with and pass through the gaps 63. The plug 93 is then rotated back (for example 90 degrees or a quarter turn) to its original orientation to align each of the blades 148 with a respective one of the inboard face 80 of the locking tabs 61*a*, 61*b*. Once all three elements, plug 93, mid-cap 94, and cover cap 92 are positioned in the final position, the fastener 96 is tightened to clamp the retainer nut assembly 26 onto the inboard locking tabs 61*a*, 61*b* and secured within the cavity 60.

It will be appreciated that the foregoing description provides examples of the disclosed system and technique. However, it is contemplated that other implementations of the disclosure may differ in detail from the foregoing examples. For example, the arc length of the blades, flange segments, and extensions may be altered from the exemplary about 90 degrees embodiment without departing from the spirit of the disclosure. The number of blades, flange segments, and extensions may be embodied in a number different from the illustrated pairs, i.e., they may be embodied as three, four, or more structures. All references to the disclosure or examples thereof are intended to reference the example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A retainer nut assembly for a pump system fluid end, comprising:

a plug comprising a pair of blades separated by edge cuts, a blade, of the pair of blades, comprising an arcuate face;

a mid-cap comprising a pair of flange segments;

a cover cap configured to be positioned adjacent the mid-cap, the cover cap including only a pair of extensions that are formed at a peripheral edge of a body of the cover cap and are separated by cut outs, and the pair of extensions being configured to align with the pair of blades while a flange segment, of the pair of flange segments, is angularly offset from the pair of extensions and the pair of blades; and a fastener configured to secure the retainer nut assembly together.

2. The retainer nut assembly of claim 1, wherein the plug includes a plug exterior face and a threaded rod extending from the plug exterior face, wherein the mid-cap includes a hole configured to receive the threaded rod, wherein the cover cap comprises a hole configured to receive the threaded rod therethrough, and wherein the fastener comprises a nut configured to engage threads of the threaded rod and secure the retainer nut assembly together when tightened.

3. The retainer nut assembly of claim 1, wherein the plug includes a plug body that is generally cylindrical, and wherein the pair of blades extend radially outward from the plug body opposite each other on the plug body.

4. The retainer nut assembly of claim 1, wherein the arcuate face is arcuate shaped and sized to match a curvature shape of an inboard face of a locking tab.

5. The retainer nut assembly of claim 1, wherein the arcuate face has a radius from about 0.25 inches to about 2 inches.

6. The retainer nut assembly of claim 1, wherein the blade is circumferentially aligned with the extension when the retainer nut assembly is assembled.

7. The retainer nut assembly of claim 1, wherein the mid-cap includes a mid-cap body that is generally cylindrical, and wherein the pair of flange segments extend radially from the mid-cap body.

8. The retainer nut assembly of claim 1, wherein the mid-cap comprises:

a mid-cap body, a mid-cap front face configured to contact the cover cap when the retainer nut assembly is assembled, and a mid-cap rear face opposite the mid-cap front face, and wherein the pair of flange segments are located on the mid-cap body closer to the mid-cap front face than the mid-cap rear face.

9. The retainer nut assembly of claim 1, wherein the mid-cap is rotationally locked to the cover cap when assembled thereto.

10. The retainer nut assembly of claim 1, wherein each of the pair of blades, the pair of flange segments, and the pair of extensions extend an arc length of about 90 degrees.

11. A fluid end of a pump system, comprising:

a fluid end block defining a fluid chamber;

a plunger reciprocally disposed in the fluid chamber to generate fluid pressure therewithin;

an outlet fluid passage formed in the fluid end block in fluid communication with the fluid chamber, the outlet fluid passage including an outlet valve;

an inlet fluid passage formed in the fluid end block in fluid communication with the fluid chamber, the inlet fluid passage including an inlet valve;

a cavity formed through the fluid end block in communication with the fluid chamber, the cavity including a first locking groove and a second locking groove, and the second locking groove being parallel to the first locking groove and disposed closer to the fluid chamber;

locking tabs separated by gaps formed in the cavity and separating the first locking groove from the second locking groove; and a retainer nut assembly configured to be secured in position within the cavity, the retainer nut assembly comprising:

a plug comprising a pair of blades configured to fit within the second locking groove and engage inboard faces of the locking tabs;

a mid-cap configured to be positioned adjacent the plug, the mid-cap comprising a pair of flange segments;

a cover cap configured to be positioned adjacent the mid-cap, the cover cap comprising only a pair of extensions separated by cut outs, and the pair of extensions being configured to align with the pair of blades while a flange segment, of the pair of flange segments, is angularly offset from the pair of extensions and the pair of blades; and a fastener configured to secure the retainer nut assembly together.

12. The fluid end of claim 11, wherein each of the pair of blades comprises an arcuate face.

13. The fluid end of claim 11, wherein an arcuate face, of a blade of the pair of blades, has a radius from about 0.25 inches to about 2 inches.

14. The fluid end of claim 11, wherein a blade, of the pair of blades, is circumferentially aligned with an extension, of the pair of extensions, when the retainer nut assembly is assembled.

15. The fluid end of claim 11, wherein the mid-cap includes a mid-cap body that is generally cylindrical, and wherein the pair of flange segments extend radially from the mid-cap body.

16. The fluid end of claim 11 wherein the mid-cap is configured to be rotationally locked to the cover cap when assembled thereto.

17. The fluid end of claim 11, wherein the retainer nut assembly, when installed and the fastener is tightened, is configured to be secured to the locking tabs.

18. A method of installing a retainer nut assembly into a cavity formed in a fluid end block, comprising positioning a plug of the retainer nut assembly in a second locking groove of the cavity;

positioning a mid-cap adjacent the plug in the cavity;

positioning a cover cap adjacent the mid-cap in the cavity in a first locking groove, the cover cap including only a pair of extensions that are formed at a peripheral edge of a body of the cover cap; and fastening the cover cap, the mid-cap, and the plug together and aligning the pair of extensions with a pair of blades, of the plug, while a flange segment, of a pair of flange segments of the mid-cap, is angularly offset from the pair of extensions and the pair of blades.

19. The method of claim 18, further comprising:

inserting the retainer nut assembly into the cavity wherein the plug enters the first locking groove;

rotating the retainer nut assembly 90 degrees;

advancing the retainer nut assembly wherein the pair of blades of the plug enter the second locking groove and the mid-cap enters the first locking groove; and rotating the retainer nut assembly 90 degrees wherein the pair of blades of the plug are circumferentially aligned with locking tabs located between the first locking groove and the second locking groove.

20. The retainer nut assembly of claim 1, wherein the pair of extensions include an extension that extends about an arc length of about 90 degrees about an outer circumference of the body of the cover cap.

* * * * *